US006183850B1

(12) United States Patent
Lauer

(10) Patent No.: US 6,183,850 B1
(45) Date of Patent: Feb. 6, 2001

(54) TARGET DEVICES

(76) Inventor: Jennifer L. Lauer, 1520 Spencer Ave., Wilmette, IL (US) 60091

( * ) Notice: Under 35 U.S.C. 154(b), the term of this patent shall be extended for 0 days.

(21) Appl. No.: 09/014,251

(22) Filed: Jan. 27, 1998

Related U.S. Application Data

(63) Continuation-in-part of application No. 08/695,312, filed on Aug. 9, 1996, which is a continuation of application No. 08/363,629, filed on Dec. 23, 1994, now abandoned.

(51) Int. Cl.[7] ..... B32B 3/26

(52) U.S. Cl. ..... 428/304.4; 428/35.7; 428/36.5; 264/DIG. 83; 4/301; 4/902

(58) Field of Search ..... 428/35.6, 304.4, 428/35.7, 36.5, 34.3, 35.4; 4/902, 300.3, 301, 661; 264/53, DIG. 83; 156/63, 258; 521/141, 82, 109.1

(56) References Cited

U.S. PATENT DOCUMENTS

| | | | | |
|---|---|---|---|---|
| 5,035,930 | * | 7/1991 | Lacourge et al. | 428/35.6 |
| 5,147,899 | * | 9/1992 | Sato et al. | 521/141 |
| 5,272,181 | * | 12/1993 | Boehmer et al. | 521/84.1 |
| 5,285,540 | * | 2/1994 | Putz | 4/661 |
| 5,343,577 | * | 9/1994 | Perovich | 4/661 |
| 5,353,449 | * | 10/1994 | Rubensteun et al. | 4/661 |

* cited by examiner

*Primary Examiner*—Deborah Jones
*Assistant Examiner*—Abraham Bahta

(57) ABSTRACT

A toilet target device comprising a water-dispersible foam polymer target floating in a toilet bowl or resting in a potty or urinal is provided. Also provide is a toilet target containing a fragrance, a method for preparing a toilet target, and a method for promoting potty training for children.

14 Claims, No Drawings

TARGET DEVICES

This application is a continuation-in-part of copending U.S. Ser. No. 08/695,312 filed Aug. 9, 1996, which is a continuation of U.S. Ser. No. 08/363,629 filed Dec. 23, 1994 now abandoned.

The present invention relates to target devices for toilets, urinals, or children's potty chairs.

BACKGROUND OF THE INVENTION

Various types of target devices for toilets or urinals have been employed in the past. Such target devices have been found useful in facilitating the toilet training of small children, improving the sanitation in public rest rooms, and as general amusement devices.

Some such target devices are coated with water resistant materials. These water resistant materials adversely impact the biodegradability of the target devices and thus are environmentally undesirable.

In addition, a growing problem is the increasing volume of disposable diapers in landfills. The diapers are not readily biodegradable and have accumulated at a surprising rate.

Further, many preschool programs require that children be potty trained. Thus, it would be helpful for children to be potty trained when they are old enough to benefit from appropriate preschool programs.

It would therefore be desirable to provide a target device which is entertaining, water-dispersible, and easily useable in all types of urinals, toilets, or children's potty chairs.

SUMMARY OF THE INVENTION

It is an object of the present invention to provide a target device that is water-dispersible.

It is another object of the present invention to provide a target device that is at least partially water soluble.

It is another object of the present invention to provide a target device that is biodegradable.

It is another object of the present invention to provide a means for facilitating the toilet training of children.

It is another object of the present invention to provide a novel amusement device useful for improving sanitation in public rest rooms.

It is another object of the present invention to provide a target device which is easily useable in all types of urinals, toilets, or children's potty chairs.

It is another object of the present invention to provide a method for promoting potty training.

It is another object of the present invention to provide a method for preparing a target device.

It is another object of the present invention to provide a method for reducing the volume of disposable diapers in landfills.

It is another object of the present invention to provide a method for preparing target devices.

In accordance with the present invention, a target device is provided comprising a water-dispersible foam polymer. In a preferred embodiment the water-dispersible polymer is biodegradable. The term biodegradable, as used herein, refers to the susceptibility of a substance to decomposition by living organisms and/or natural environmental factors. In an especially preferred embodiment, the target device comprises a biodegradable polymer which is at least partially water soluble. Also provided are a method for promoting potty training of children and a method for making a toilet target.

DETAILED DESCRIPTION OF THE INVENTION

This application is a continuation-in-part of U.S. Ser. No. 08/695,312 filed Aug. 9, 1996, which is a continuation of U.S. Ser. No. 08/363,629 filed Dec. 23, 1994 the disclosures of which are incorporated herein by reference.

Suitable water-dispersible polymers employed in the target devices can be prepared by any method known in the art. Typical methods are disclosed in U.S. Pat. Nos. 5,153,037; 5,043,196; 5,035,930; 4,863,655; and 5,272,181 the disclosures of which are herein incorporated by reference. Many such polymers are commercially available and can be obtained from American Excelsior Company, Arlington, Tex.; National Starch & Chemical Inc., Bridgewater, N.J.; Evergreen Solutions, Inc., Minneapolis, Minn.; Air Products & Chemicals, Inc., Allentown, Pa.; Novon Products Company, Morris Plains, N.J.; and Novamont North America, New York, N.Y.

Examples of water-dispersible polymers include hydroxybutyrate-hydroxyvalerate copolymer, cellulosics, poly(lactic acid), polycaprolactone, starches, modified starch products, high amylose starch products, poly(vinyl alcohol), hydroxyethylcellulose, poly(ethylene glycol), and mixtures thereof.

Typically the water-dispersible polymers disperse in water in a period of time in the range of from 1 second to 30 minutes, preferably in the range of from 1 second to 20 minutes, and more preferably in the range of from 1 second to 10 minutes.

In a preferred embodiment, the target device comprises a water-dispersible polymer which is biodegradable. In an especially preferred embodiment, the water-dispersible polymer at least partially dissolves in water. Examples of suitable water-soluble polymers include high amylose starch products containing at least 40% by weight amylose, poly (vinyl alcohol), hydroxyethylcellulose, poly(ethylene glycol), and mixtures thereof.

The water-dispersible polymer can be in any suitable form such as film, sheet, or foam. Foam products are preferred because of their ease of handling, rigidity, printability and floatability. The polymer can contain coloring agents and the target can comprise one or more colors.

The target device can be any desired shape or form. If a printed target device is desired, generally the target device will comprise a thin planar element. Designs can be created on blank target devices by the individual user. If the target devices are printed, the printing can be accomplished by any means known in the art. Generally the target device will be free floating.

Typically target devices for children can be prepared in the shape of or printed with animals, including dinosaurs, zoo animals, pets, farm animals, fish, frogs, snakes birds, as well as geometric shapes, rings, fictional characters such as storybook, comic book or cartoon characters, space men, space ships, sun, moon, stars, soldiers, flowers, a bull's-eye, numbers, letters, words, names of children or fictional characters, historic persons, countries, states, continents, boats, trains, cars, trucks, bicycles, tricycles, wagons, toys, combinations thereof or any design of interest to children. If the target devices are for adults, the target devices can be printed with political figures, a bull's-eye, or any such design.

Three-dimensional, sculptured or bas-relief, target devices are also within the realm of the present invention. Such devices can represent any of the above noted items such as animals including dinosaurs, zoo animals, pets, farm animals, fish, frogs, snakes, birds, as well as geometric shapes, rings, fictional characters such as storybook, comic book or cartoon characters, historic persons, countries, states, continents, space men, space ships, sun, moon, stars, soldiers flowers, political figures, numbers, letters, words, names of children or fictional characters, boats, trains, cars, trucks, bicycles, tricycles, wagons, toys, combinations thereof, or any form of interest.

The size of the target device can vary broadly depending on the particular use. Generally, in the case of a planar target device, the size will be in the range of from about 0.1 $cm^2$ to about 400 $cm^2$, preferably from about 1 $cm^2$ to about 300 $cm^2$, and more preferably from 1 $cm^2$ to 250 $cm^2$. Likewise, the thickness can vary broadly depending on the particular use and manipulation of the target device.

For example if the target device is to be printed, the target device should be sufficiently thick to withstand the rigors of the particular printing. If the target device is imprinted with a three dimensional effect, the target will be somewhat thicker. Generally the target device will have a thickness in the range of from about 1 mm to about 30 mm, preferably from 1 mm to about 25 mm, and more preferably from 1 mm to 20 mm.

Generally, in the case of a three-dimensional target device, the size will be in the range of from abut 1 cc to about 1500 cc, preferably from about 1 cc to about 1000 cc, more preferably from about 1 cc to about 750 cc, and most preferably from 1 cc to 500 cc.

The target device can be prepared by any method known in the art which is appropriate for the material selected. For example a predetermined form can be cut from sheet material by means of a scissors, knife or die. Forms which are 3-dimensional can be formed by injection molding or other suitable methods.

In one embodiment, the target device contains a fragrance. The fragrance can be derived from any material known in the art as long as the fragrance or material containing the fragrance are compatible with the composition of the target device. Many such fragrances are commercially available as oils. Sources where fragrances can be purchased include Scentastics, Inc., Coral Springs, Fla. and Intercontinental Fragrances, Houston, Tex.

Suitable fragrances include floral, spice, herb, evergreen and various extracts. Examples of fragrances include amber, baby powder, bayberry, lilac, cinnamon, coconut, frankincense, gardenia, almond, heather, peach, honeysuckle, jasmine, lily of the valley, myrrh, orange blossom, pine, raspberry, strawberry, rose, vanilla, pineapple, watermelon, peppermint, spearmint, bergamot, sandalwood, cedarwood, cinnamon, sage, clove, geranium, eucalyptus, ginger, grapefruit, lemon, lime, orange, tangerine, rosemary, lavender, and marjoram.

The fragrance can be infused into the polymer by any method known in the art. The fragrance can be blended with the polymer after polymerization or sprayed onto the completed target or any other convenient method for bringing the fragrance in contact with the material.

The Target device provides a unique, useful and entertaining means of promoting toilet training for toddlers. Further, the target device provides improved sanitation for all ages since one's focus is directed to the target device. The target device can be floated in a toilet bowl or placed in the bottom of a potty chair or urinal. The target device is readily dispersible and/or flushable.

That which is claimed:

1. A method for making a toilet target comprising preparing a predetermined shape from a water-dispersible foam polymer to produce the toilet target.

2. A method for promoting potty training of children comprising placing a water-dispersible foam polymer target in a toilet bowl, potty or urinal to encourage the child to use the toilet bowl, potty or urinal.

3. The method of claim 1 wherein the polymer is biodegradable.

4. The method of claim 1 wherein the polymer disperses in water in a period of time in the range of from 1 second to 30 minutes.

5. The method of claim 4 wherein the polymer disperses in water in a period of time in the range of from 1 second to 10 minutes.

6. The method of claim 1 wherein the polymer partially dissolves in water.

7. The method of claim 1 wherein the polymer comprises starches, modified starch products, high amylose starch products containing at least 40% by weight amylose, poly (vinyl alcohol), hydroxyethylcellulose, or poly(ethylene glycol), or mixtures thereof.

8. The method of claim 7 wherein the polymer comprises high amylose starch products containing at least 40% by weight amylose.

9. The method of claim 1 wherein the shape is planar in structure.

10. The method of claim 9 further comprising printing the shape with a design.

11. The method of claim 1 wherein the shape is three-dimensional in shape.

12. The method of claim 1 wherein a fragrance is infused in the target.

13. The method of claim 1 wherein the foam polymer is injected into a mold.

14. The method of claim 1 wherein the predetermined shape is cut with a die from polymer sheets, wherein the shape is in the form of animals, geometric shapes, storybook or fictional characters, flowers, a bull's-eye, numbers, letters, words, names of children or fictional characters, boats, trains, cars, trucks, bicycles, tricycles, wagons, toys or combinations thereof, with the proviso that when the target is in the shape of an animal, the shape is not a fish.

* * * * *